US008888554B2

(12) United States Patent
Finizza

(10) Patent No.: US 8,888,554 B2
(45) Date of Patent: Nov. 18, 2014

(54) TOY PLAYSET WITH SOCKETS

(75) Inventor: Michael Finizza, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 463 days.

(21) Appl. No.: 13/296,653

(22) Filed: Nov. 15, 2011

(65) Prior Publication Data

US 2012/0129423 A1 May 24, 2012

Related U.S. Application Data

(60) Provisional application No. 61/413,893, filed on Nov. 15, 2010.

(51) Int. Cl.

| | |
|---|---|
| ***A63H 17/26*** | (2006.01) |
| ***A63H 17/00*** | (2006.01) |
| ***A63H 18/14*** | (2006.01) |
| ***A63H 33/42*** | (2006.01) |
| ***A63H 18/02*** | (2006.01) |

(52) U.S. Cl.

CPC ..... *A63H 33/42* (2013.01); *A63H 17/00* (2013.01); *A63H 18/02* (2013.01)

USPC ..... 446/427; 446/429; 446/445

(58) Field of Classification Search

USPC ..... 446/104, 111, 120, 124, 126, 427, 428, 446/429, 71–76, 478, 487, 445

See application file for complete search history.

(56) References Cited

U.S. PATENT DOCUMENTS

| | | | |
|---|---|---|---|
| 1,246,921 | A | 11/1917 | Holt et al. |
| 1,384,114 | A | 7/1921 | Aektold et al. |
| 1,926,695 | A | 9/1933 | Hutton et al. |
| 2,837,863 | A | 6/1958 | Duvall |
| 3,408,768 | A | 11/1968 | Glass et al. |
| 3,540,153 | A | 11/1970 | Masaru Aoki et al. |
| 3,613,306 | A | 10/1971 | Toshikatsu et al. |
| 3,629,875 | A | 12/1971 | Dow et al. |
| 3,716,940 | A | 2/1973 | Bosley |
| 3,841,018 | A | 10/1974 | Reiling |

(Continued)

FOREIGN PATENT DOCUMENTS

| | | |
|---|---|---|
| CN | 101652161 | 2/2010 |
| CN | 101772367 | 7/2010 |

(Continued)

OTHER PUBLICATIONS

WIPO, Kim Young Hun, Authorized Officer; International Search Report for PCT/US2011/060770; Mailing Date May 25, 2012; 3 pages.

(Continued)

*Primary Examiner* — Nini Legesse

(74) *Attorney, Agent, or Firm* — Kolisch Hartwell, PC

(57) ABSTRACT

A toy playset is provided. The toy playset may include a base having a first play surface and may further include a first socket attached to the first play surface. The first socket may include a central detent configured to releasably retain a toy wheel with a portion of the toy wheel held inside the central detent. The first socket may include a pair of lateral detents configured to releasably retain a toy axle. The lateral detents may extend across the first socket and may intersect the central detent. The lateral detents may be narrower than the central detent.

24 Claims, 5 Drawing Sheets

(56) References Cited

U.S. PATENT DOCUMENTS

| | | | | |
|---|---|---|---|---|
| 3,883,987 | A | 5/1975 | Joshi et al. | |
| 3,886,682 | A * | 6/1975 | Ieda et al. | 446/429 |
| 4,051,624 | A | 10/1977 | Ogawa | |
| 4,060,930 | A | 12/1977 | Hirtle et al. | |
| 4,068,402 | A | 1/1978 | Tanaka | |
| 4,205,484 | A | 6/1980 | Kovac et al. | |
| 4,221,076 | A | 9/1980 | Ozawa | |
| 4,235,370 | A | 11/1980 | Newby | |
| 4,349,983 | A | 9/1982 | Kilroy et al. | |
| 4,500,299 | A | 2/1985 | Kelley et al. | |
| 4,526,554 | A | 7/1985 | Goldfarb et al. | |
| 4,558,867 | A | 12/1985 | Hippely | |
| 4,575,350 | A | 3/1986 | Hippely et al. | |
| 4,581,904 | A | 4/1986 | Lehmann et al. | |
| 4,669,657 | A | 6/1987 | Crain et al. | |
| 4,676,762 | A * | 6/1987 | Ballard | 446/104 |
| 4,685,728 | A | 8/1987 | Rebollo | |
| 4,740,187 | A | 4/1988 | Rasmussen et al. | |
| 4,756,703 | A * | 7/1988 | Kennedy et al. | 446/26 |
| D300,073 | S | 2/1989 | Crump | |
| 4,883,443 | A | 11/1989 | Chase | |
| 4,937,207 | A | 6/1990 | Simmell et al. | |
| 4,946,413 | A | 8/1990 | Lehmann et al. | |
| 4,961,716 | A | 10/1990 | Hippely et al. | |
| 5,069,647 | A * | 12/1991 | Zuviria | 446/127 |
| 5,104,124 | A | 4/1992 | Bernard et al. | |
| 5,174,569 | A | 12/1992 | Ngai | |
| 5,248,276 | A | 9/1993 | Deleon | |
| 5,360,028 | A | 11/1994 | Jasin | |
| 5,440,996 | A | 8/1995 | Cottino | |
| 5,441,435 | A | 8/1995 | Shiraishi | |
| 5,503,411 | A * | 4/1996 | Sundberg et al. | 280/1.188 |
| 5,525,088 | A | 6/1996 | Mayne | |
| 5,758,777 | A | 6/1998 | Dods | |
| 5,826,394 | A * | 10/1998 | Barton et al. | 52/592.1 |
| 5,839,937 | A | 11/1998 | Thomas | |
| 5,931,099 | A | 8/1999 | Bruner et al. | |
| 6,083,078 | A | 7/2000 | Yang | |
| 6,099,380 | A | 8/2000 | Rasmussen | |
| 6,138,701 | A | 10/2000 | Zheng | |
| 6,168,494 | B1 | 1/2001 | Engel et al. | |
| 6,283,819 | B1 | 9/2001 | Polinger et al. | |
| 6,517,408 | B1 * | 2/2003 | Rehkemper et al. | 446/462 |
| 6,663,464 | B2 | 12/2003 | Payne et al. | |
| 6,684,894 | B2 | 2/2004 | Zheng | |
| 6,752,164 | B1 | 6/2004 | Park | |
| 6,783,419 | B1 | 8/2004 | Paukert et al. | |
| 7,285,034 | B2 | 10/2007 | Kay et al. | |
| 7,537,509 | B2 | 5/2009 | Payne et al. | |
| 7,549,906 | B2 | 6/2009 | Bedford et al. | |
| 7,594,844 | B2 | 9/2009 | Cartlidge et al. | |
| 7,614,931 | B2 | 11/2009 | Nuttall | |
| 7,618,301 | B2 | 11/2009 | Knight et al. | |
| 7,618,302 | B2 | 11/2009 | Collins et al. | |
| 7,628,674 | B2 | 12/2009 | Nuttall et al. | |
| 7,686,669 | B2 | 3/2010 | Sun et al. | |
| 7,690,964 | B2 | 4/2010 | Nuttall et al. | |
| 2004/0009734 | A1 | 1/2004 | Needham | |
| 2004/0266316 | A1 | 12/2004 | Li et al. | |
| 2005/0090178 | A1 | 4/2005 | Snyder | |
| 2005/0164594 | A1 | 7/2005 | Garr | |
| 2006/0014472 | A1 | 1/2006 | Spielberger | |
| 2006/0021905 | A1 | 2/2006 | Johnson | |
| 2007/0010161 | A1 | 1/2007 | Young | |
| 2007/0178800 | A1 * | 8/2007 | Kim | 446/124 |
| 2007/0293123 | A1 | 12/2007 | Nuttall | |
| 2008/0081536 | A1 | 4/2008 | Payne | |
| 2009/0004949 | A1 | 1/2009 | Payne | |
| 2009/0130946 | A1 | 5/2009 | Fink et al. | |
| 2010/0056015 | A1 | 3/2010 | Nuttall | |
| 2010/0075573 | A1 | 3/2010 | Dubois | |

FOREIGN PATENT DOCUMENTS

| | | |
|---|---|---|
| EP | 0555188 | 8/1993 |
| EP | 0937819 | 8/1999 |
| GB | 2178331 | 2/1987 |
| GB | 2246305 | 1/1992 |
| WO | 9311843 | 6/1993 |

OTHER PUBLICATIONS

WIPO, Kim Young Hun, Authorized Officer; Written Opinion of the International Searching Authority for PCT/US2011/060770; Mailing Date May 25, 2012; 5 pages.

Wikipedia; Retractable Bridge Thrust Bridge; retrieved May 22, 2010; 2 pages.

Star Wars Archive Database; Kenner Hasbro Star Wars Death Star Retractable Bridge; "First Issued 1978"; 4 pages.

Kenner Products; Instructions for Kenner Hasbro Star Wars Death Star Retractable Bridge; copyright 1978; 6 pages.

The International Bureau of WIPO, International Preliminary Report on Patentability for PCT Application No. PCT/US2011/060770, May 30, 2013, 7 pages.

State Intellectual Property Office of the People'S Republic of China, Office Action for Chinese Patent Application No. 201180053972.1, Aug. 1, 2014, 16 pages.

* cited by examiner

TOY PLAYSET WITH SOCKETS

CROSS-REFERENCE TO RELATED APPLICATIONS

This application claims priority to U.S. Provisional Patent Application Ser. No. 61/413,893, filed Nov. 15, 2010 and entitled TOY PLAYET WITH SWIVELING SURFACES AND MULTIPURPOSE HOLDERS, the disclosure of which is incorporated herein by reference.

BACKGROUND

The present disclosure is directed generally to toy playsets and, more particularly, to toy playsets including one or more sockets, also referred to as holders. Some embodiments of a toy playset may include a movable play surface. Examples of toy playsets having moveable surfaces and/or holders are disclosed in U.S. Pat. Nos. 4,500,299, 4,526,554, 6,168,494, and 6,783,419.

SUMMARY

In some examples, a toy playset is provided. The toy playset may include a base having a first play surface and may further include a first socket attached to the first play surface. The first socket may include a central detent configured to releasably retain a toy wheel with a portion of the toy wheel held inside the central detent. The first socket may include a pair of lateral detents configured to releasably retain a toy axle. The lateral detents may extend across the first socket and may intersect the central detent. The lateral detents may be narrower than the central detent.

The toy playset may further include a second play surface attached to the base and moveable with respect to the first play surface and a second socket attached to the second play surface. The second socket may include a central detent configured to releasably retain a toy wheel with a portion of the toy wheel held inside the central detent, and a pair of lateral detents configured to releasably retain a toy axle. The lateral detents may extend across the second socket and intersect the central detent. The lateral detents may be narrower than the central detent.

The toy playset may further include a third play surface attached to the base and moveable with respect to the first play surface and a third socket attached to the third play surface. The third socket may include a central detent configured to releasably retain a toy wheel with a portion of the toy wheel held inside the central detent, and a pair of lateral detents configured to releasably retain a toy axle, with the lateral detents extending across the third socket and intersecting the central detent, the lateral detents being narrower than the central detent.

In some embodiments of the toy playset, the second socket may be rotatably attached to the second play surface and the third socket may be slidingly attached to the third play surface. In some embodiments, at least one of the second play surface and the third play surface may be pivotally attached to the base and may pivot with respect to the first play surface. Additionally and/or alternatively, the first socket may be rotatably attached to the first play surface. In some embodiments, the base may include a carrying handle.

The toy playset may further include a tow vehicle slidingly moveable on the first play surface, the tow vehicle including a tow socket. The tow socket may include a central detent configured to releasably retain a toy wheel with a portion of the toy wheel held inside the central detent, and a pair of lateral detents configured to releasably retain a toy axle, with the lateral detents extending across the first socket and intersecting the central detent, the lateral detents being narrower than the central detent.

An example of a toy playset for use with toy vehicles, the vehicles including one or both of a single toy wheel and an axle supporting a pair of wheels, is also provided. The toy playset may include a base having a first play surface and a first socket attached to the first play surface. The first socket may have a first retainer configured to releasably retain a single toy wheel within the first retainer in an exposed face of the first socket. The first socket may have a second retainer extending across the first socket. The second retainer may be configured to releasably retain an axle supporting a pair of wheels, with each of a pair of wheels held outside of the second retainer.

In some embodiments of the toy playset, the first retainer may include a central detent and the second retainer may include a pair of lateral detents, the lateral detents extending across the first socket and intersecting the central detent, the lateral detents being narrower than the central detent.

Some embodiments of the toy playset may include a second play surface attached to the base and moveable with respect to the first play surface and a second socket attached to the second play surface. The second socket may have a first retainer configured to releasably retain a single toy wheel within the first retainer in an exposed face of the second socket and the second socket may have a second retainer extending across the second socket, the second retainer configured to releasably retain a toy axle supporting a pair of wheels, with each of a pair of wheels held outside of the second retainer.

Some embodiments of the toy playset may include a third play surface attached to the base and moveable with respect to the first play surface and a third socket attached to the third play surface. The third socket may have a first retainer configured to releasably retain a single toy wheel within the first retainer in an exposed face of the third socket and the third socket may have a second retainer extending across the third socket, the second retainer configured to releasably retain a toy axle supporting a pair of wheels, with each of a pair of wheels held outside of the second retainer.

A further example of a toy playset for use with toy vehicles, the vehicles including one or both of a single toy wheel and an axle supporting a pair of wheels, is provided. The playset may include a base having a first play surface, a second play surface attached to the base and moveable with respect to the first play surface and a socket attached to the second play surface. The socket may have a first retainer configured to releasably retain a single toy wheel within the first retainer in an exposed face of the socket and the socket may have a second retainer configured to releasably retain a toy axle supporting a pair of wheels, with each of a pair of wheels held outside of the socket.

In some embodiments of the toy playset, the socket may be rotatably attached to the second play surface and/or the second play surface may be pivotally attached to the base and may pivots with respect to the first play surface. Additionally and/or alternatively, the first retainer may include a central detent and the second retainer may include a pair of lateral detents, the lateral detents extending across the socket and intersecting the central detent, the lateral detents being narrower than the central detent. In some embodiments, the base may include a carrying handle.

Some embodiments of the toy playset may further include a tow vehicle slidingly moveable on the first play surface and the second play surface, the tow vehicle including a tow socket. The tow socket may have a first retainer configured to releasably retain a single toy wheel within the first retainer in an exposed face of the tow socket and the tow socket may have a second retainer configured to releasably retain a toy axle supporting a pair of wheels, with each of a pair of wheels held outside of the tow socket. Some embodiments of the toy playset may further include a third play surface attached to the base and moveable with respect to the first play surface.

The advantages of the present disclosure will be understood more readily after a consideration of the drawings and the Detailed Description.

DETAILED DESCRIPTION OF THE DISCLOSURE

Figure 1:
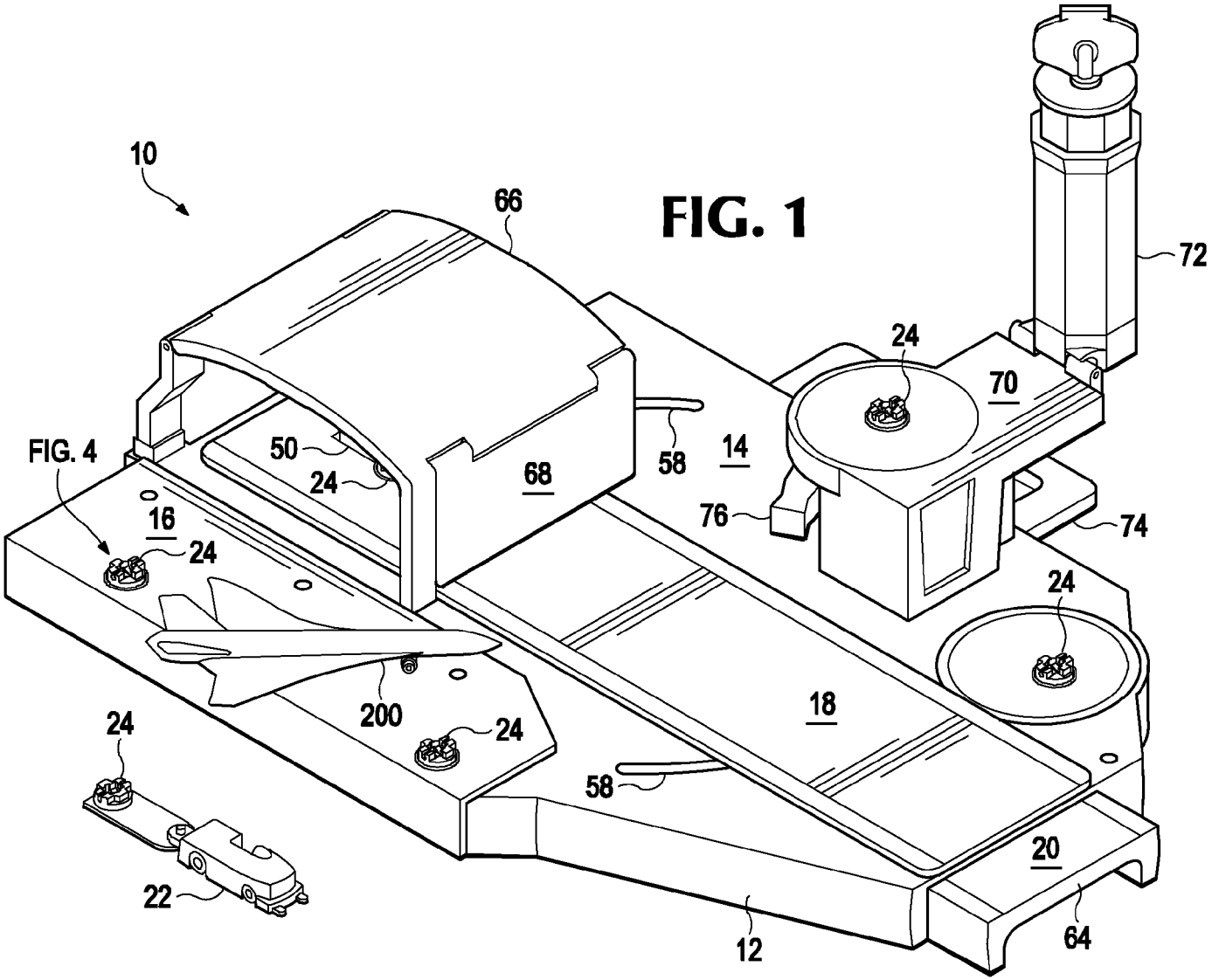
FIG. 1 is a perspective top view of an embodiment of a toy playset including a plurality of sockets and having moveable surfaces in a storage position, in accordance with the present disclosure.
Figure 2:
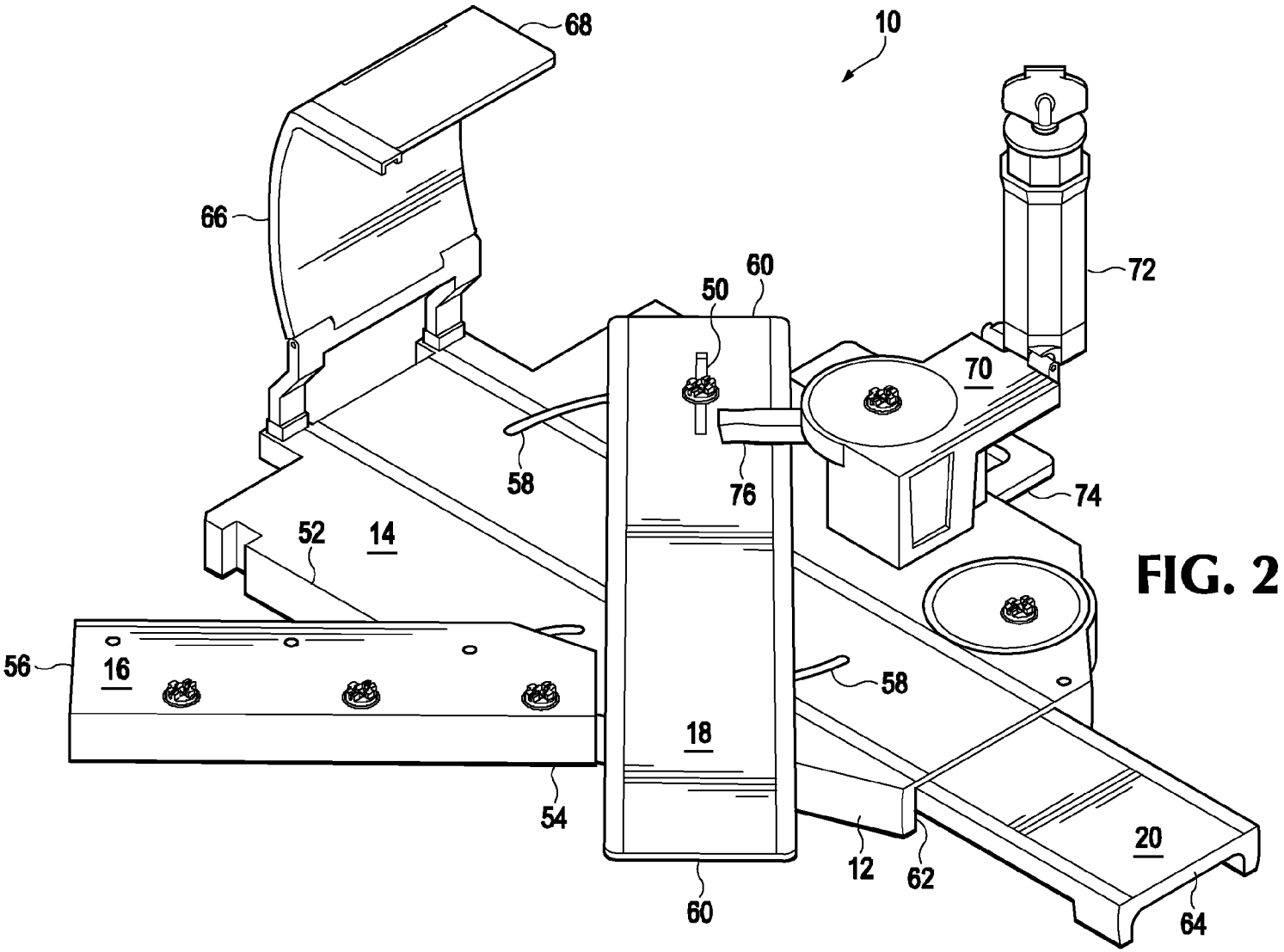
FIG. 2 is a perspective top view of the embodiment shown in FIG. 1, the toy playset having moveable surfaces in an expanded position in accordance with the present disclosure.

As shown in FIGS. 1 and 2 an exemplary toy playset, indicated generally at 10, may include a base 12 having a first play surface 14. Toy playset 10 may also include one or more of a second play surface 16, a third play surface 18, also referred to as first and second swiveling platforms, and/or a fourth play surface 20, also referred to a pull-out platform, one or all of which may be moveable with respect to first play surface 14. FIG. 1 shows toy playset 10 in a retracted or storage position and FIG. 2 shows toy playset 10 in an expanded position. Some embodiments of toy playset 10 may also include a tow vehicle 22 (FIG. 1) slidingly moveable on one or all of the first, second, third and/or fourth play surfaces 14, 16, 18, 20.

Figure 3A:
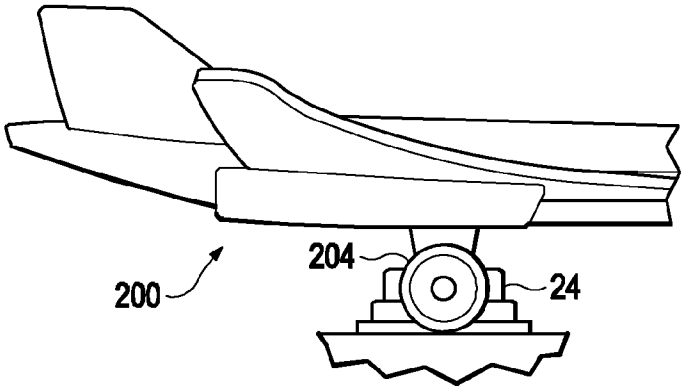
FIG. 3*a* is a side view of a toy vehicle including an axle supporting a pair of wheels, showing a partial sectional view of at toy play set wherein the axle is releasably retained by a socket, in accordance with the present disclosure.
Figure 3B:
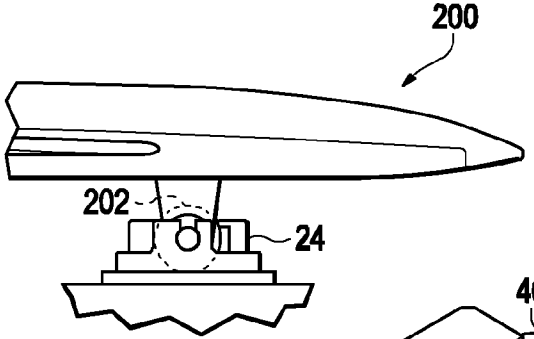
FIG. 3*b* is a side view of a toy vehicle including a single toy wheel, showing a partial sectional view of at toy play set wherein the toy wheel is releasably retained by a socket, in accordance with the present disclosure.

Toy playset 10 may also include one or more sockets 24 attached to one or more of the first, second, third and/or fourth play surfaces 14, 16, 18, 20 and tow vehicle 22. As shown in FIGS. 3*a* and 3*b*, one or more sockets 24 may be configured to releasably retain a toy vehicle 200 including one or both of an individual toy wheel 202 (FIG. 3*b*) and a toy axle 204 supporting a pair of wheels 206 (FIG. 3*a*).

FIGS. 4-9 are partial views of toy playset 10 including socket 24. Socket 24 may include a first retainer 26 configured to releasably retain toy wheel 202 within first retainer 26 in an exposed face 28 of socket 24. Socket 24 and/or first retainer 26 may include a central detent 30 configured to releasably retain toy wheel 202 with a portion of toy wheel 202 held inside central detent 30. In some embodiments, socket 24 and/or first retainer 26 may include a central detent 30 configured to releasably retain toy wheel 202 with a substantial portion of toy wheel 202 held inside central detent 30.

Socket 24 may also include a second retainer 32 extending across socket 24. Second retainer 32 may be configured to releasably retain axle 204 supporting a pair of wheels 206, with each of a pair of wheels 206 held outside of second retainer 32. Socket 24 may further include a pair of lateral detents 34 configured to releasably retain toy axle 204. Lateral detents 34 may extend across socket 24 and/or may intersect central detent 30. Lateral detents 34 may be narrower than central detent 30. In some embodiments, lateral detents 34 may be substantially narrower than central detent 30.

One or more sockets 24 may be additionally and/or alternatively described as configured clamp onto one or both of (a) one or more wheel(s) of a toy vehicle, where the one or more wheels are relatively close to one another; and (b) an axle associated with two or more wheels of a toy vehicle, where the two or more wheels are relatively widely spaced apart.

Figure 5:
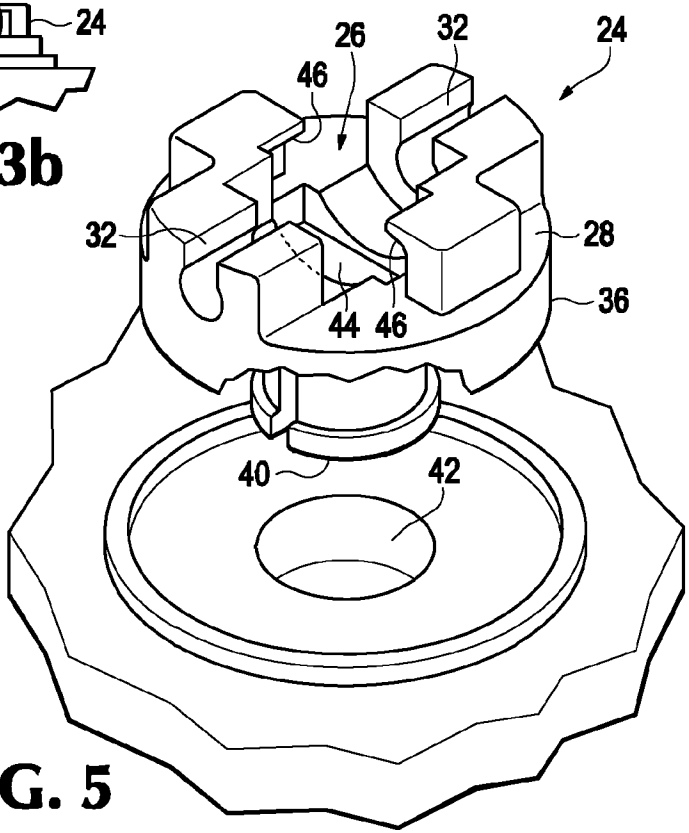
FIG. 5 is a partial top perspective view of the toy playset shown in FIG. 4, showing socket 24 attached to the play surface, in accordance with the present disclosure.
Figure 4:
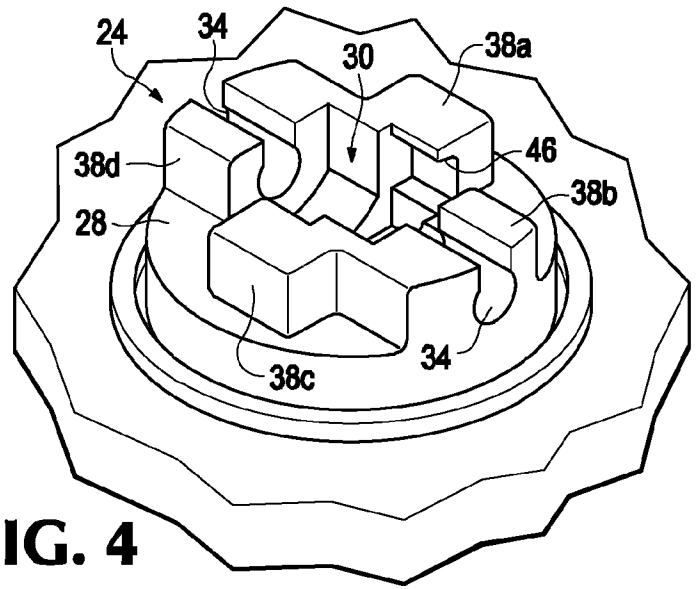
FIG. 4 is a partial top perspective view of a toy playset including a play surface and a socket configured to releasably retain a toy wheel and/or a toy axle supporting a pair of wheels, removed from the play surface, in accordance with the present disclosure.

Some embodiments of socket 24 may include exposed face 28 of socket 24 and a circular base 36. Second retainer 32 may extend across the width or diameter of circular base 36. First retainer 26 may be centrally disposed within exposed face 28 of socket 24, for example first retainer 26 may be substantially centrally disposed within exposed face 28 of socket 24. Socket 24 may further include one or more teeth that may define the first and/or second retainer. For example, socket 24 may include four teeth 38*a*, 38*b*, 38*c*, and 38*d*, which may define the first and second retainers 26, 32. As shown in FIG. 5, socket 24 may further include an attachment leg 40 that is insertable in an attachment aperture 42 in one or more of the first, second, third and/or fourth play surfaces 12, 14, 16, 18, 20 and/or tow vehicle 22.

As noted above, first retainer 26 may include central detent 30 and second retainer 32 may include pair of lateral detents 34. The bottom of central detent 30 may include a wheel detent 44 that may extend perpendicular to pair of lateral detents 34. Central detent 30 may also include overhanging sections 46 that may be configured to assist in the reliable retention of a toy wheel. For example, central detent 30 may include overhanging sections 46 on opposing sides of central detent 30 and catty corner to one another.

Figure 6:
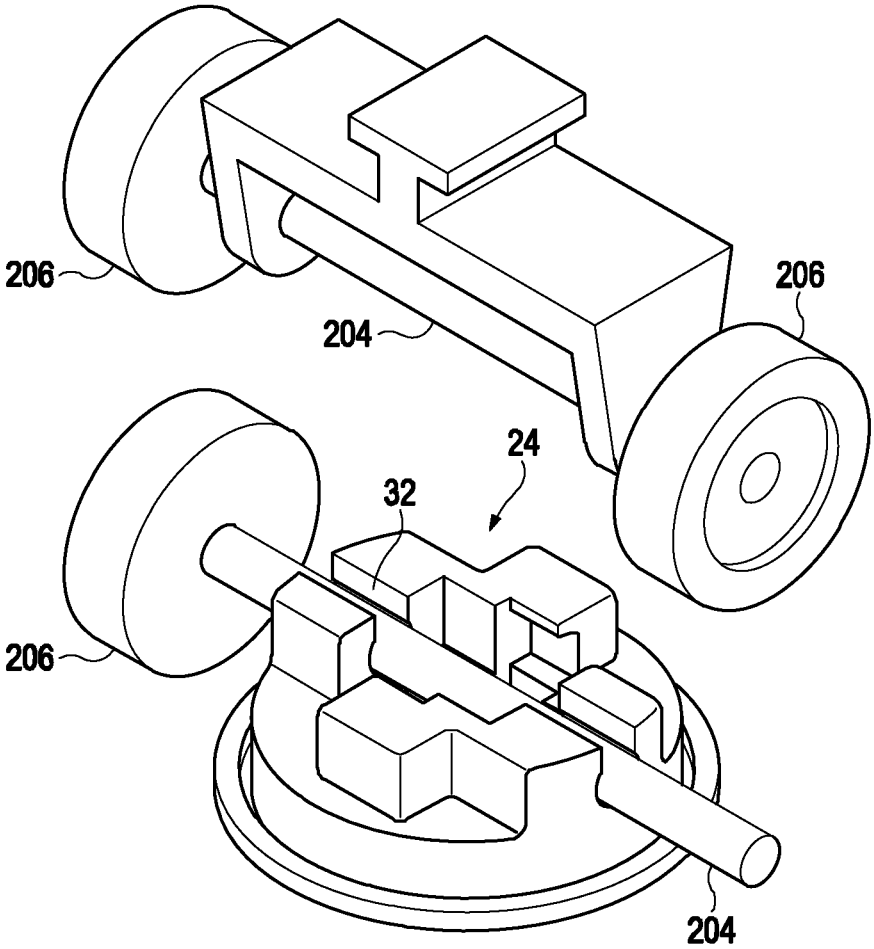
FIG. 6 is a partial top perspective view of a toy playset including a socket and showing an exemplary toy axle supporting a pair of wheels outside of the socket and an exemplary toy axle releasably retained by the socket, in accordance with the present disclosure.
Figure 7:
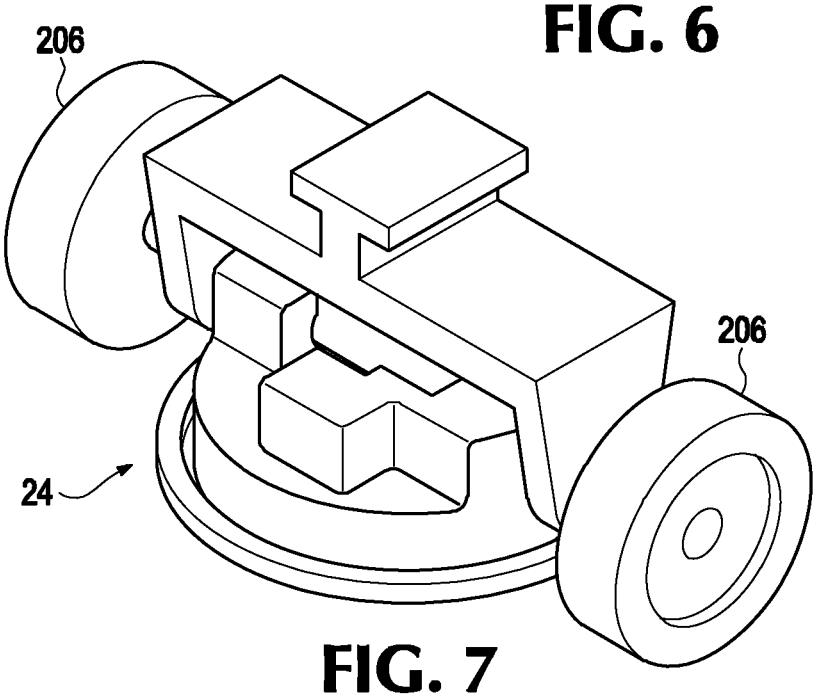
FIG. 7 is a partial top perspective view of the toy playset of FIG. 6, showing the socket releasably retaining the toy axle supporting a pair of wheels, in accordance with the present disclosure.

FIGS. 6 and 7 show exemplary releasable retention of toy axle 204 supporting a pair of wheels 206 in socket 24. FIG. 6 shows toy axle 204 supporting a pair of wheels 206. FIG. 6 further shows socket 24 releasably retaining toy axle 204. FIG. 7 shows toy axle 204 supporting a pair of wheels 206, the toy axle 204 being releasably retained by second retainer 32, with each of the pair of wheels 206 held outside of second retainer 32 and with each of the pair of wheels 206 held outside of socket 24. FIG. 7 further shows lateral detents 34 configured to releasably retain toy axle 204. Lateral detents 34 may be somewhat smaller than axle 204 in width and somewhat larger than axle 204 in depth, such that axle 204 may be press fit into lateral detents 34 for releasable retention and lateral detents 34 may partially surround axle 204.

Figure 8:
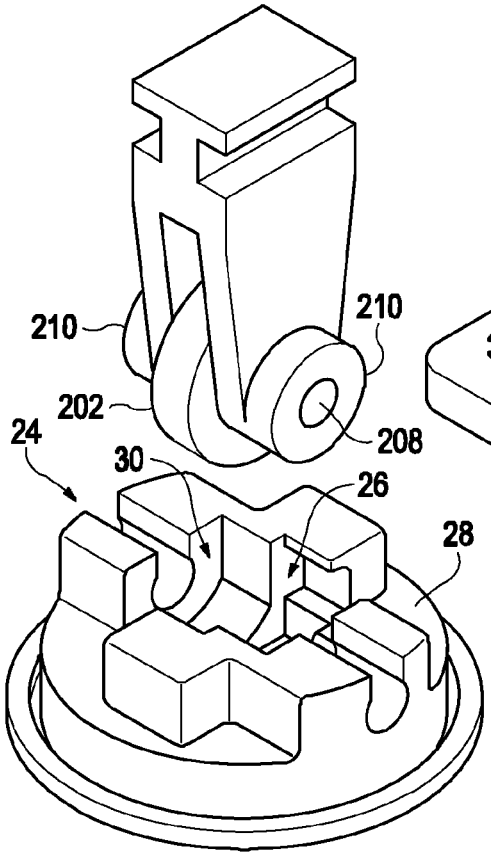
FIG. 8 is a partial top perspective view of the toy playset of FIG. 6, showing the socket and showing an exemplary toy wheel outside of the socket, in accordance with the present disclosure.
Figure 9:
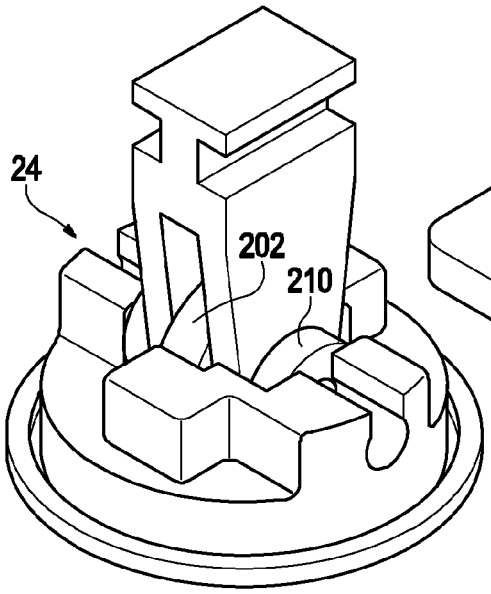
FIG. 9 is a partial top perspective view of the toy playset of FIG. 6, showing the socket releasably retaining the toy wheel, in accordance with the present disclosure.

FIGS. 8 and 9 show exemplary releasable retention of toy wheel 202. FIG. 8 shows toy wheel 202 outside of socket 24 and FIG. 9 shows toy wheel 202 releasably retained within first retainer 26 in exposed face 28 of socket 24. FIG. 9 further shows central detent 30 configured to releasably retain toy wheel 202 with a portion, such as a substantial portion, of toy wheel 202 held inside central detent 30. The lower end to wheel 202 may fit within wheel detent 44. Central detent 30 may further be configured to retain all or a portion of an axle 208 and/or a wheel mount 210 supporting wheel 202.

Figure 10:
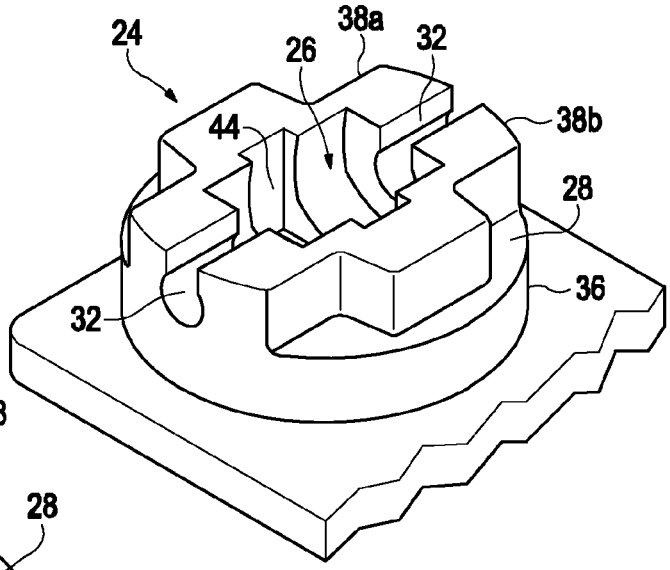
FIG. 10 is a partial top perspective view of a toy playset including an alternative embodiment of a socket configured to releasably retain a toy wheel and/or a toy axle supporting a pair of wheels, in accordance with the present disclosure.
Figure 11:
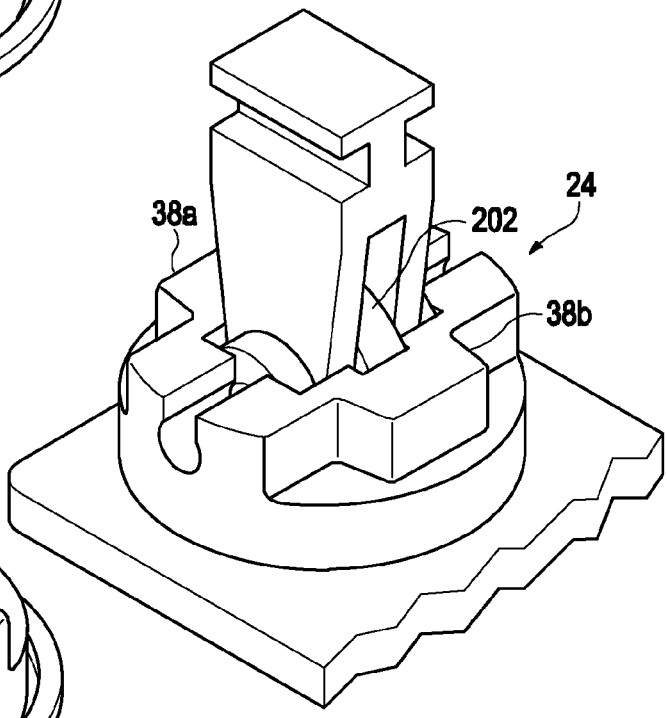
FIG. 11 is a partial top perspective view of the toy playset of FIG. 10, showing the socket releasably retaining an exemplary toy wheel, in accordance with the present disclosure.

An alternative embodiment of socket 24 is shown in FIGS. 10 and 11. As noted above, socket 24 may further include one or more teeth that may define the first and/or second retainers. For example, socket 24 may include two teeth 38*a* and 38*b* that may define the first and second retainers 26, 32.

Turning now to FIGS. 1 and 2, as noted above playset 10 may include one or more sockets 24 and one or more sockets 24 may be attached to one or more of the first, second, third and/or fourth play surfaces 14, 16, 18, 20 and tow vehicle 22. One or more sockets 24 may be fixedly, rotatably and/or slidably attached. For example, socket 24 may be rotatably attached to first play surface 14. Additionally and/or alternatively, socket 24 may be rotatably attached to second play surface 16. Additionally and/or alternatively, socket 24 may be fixedly attached to tow vehicle 22. Additionally and/or alternatively, socket 24 may be slidingly attached to third play surface 18, for example socket 24 may be slidably along a socket aperture 50.

Second play surface 16 may be disposed along an edge 52 of first play surface 14 and may be hingedly attached to base 12 at a hinge end 54 of second play surface 16. In the stowed position, second play surface 16 may lie alongside edge 52 and/or partially lie on top of first play surface 14. In the expanded position, a free end 56 of second play surface 16 may be spaced from the edge of first play surface 14.

Third play surface 18 may be primarily disposed on first play surface 14 and may be slidably or pivotally attached to base 12 via one or more sliding bolt(s) (not shown) on the underside of third play surface 18 that are inserted and slidably moveable along one or more elongated curved aperture(s) 58 in first play surface 14. Third play surface 18 may pivot with respect to first play surface 12. In the stowed position, third play surface 18 may be aligned with fourth play surface 20. In the expanded position, third play surface 18 may extend at an acute angle relative to fourth play surface 20, and one or more ends 60 of third play surface 18 may extend beyond edge 52 of first play surface 14.

Base 12 may include a cavity 62 sized to receive fourth play surface 20 such that fourth play surface 20 may be shifted from an expanded position, in which a free end 64 of fourth play surface 20 is spaced from edge 52 of first play surface 14, to a retracted or storage position, in which the majority of fourth play surface 20 is within cavity 62. Free end 64 of fourth play surface 20 may protrude slightly from cavity 62 when fourth play surface 20 is fully retracted into base 12 so as to be readily graspable by a user.

Playset 10 may include an enclosure 66 having an openable door 68 disposed on first play surface 14 and third play surface 18. Enclosure 66 is preferably sized so as to receive toy vehicle 200. Door 68 may be provided with a suitable friction fit or snap-lock arrangement in order to maintain door in a closed position.

Playset 10 may include a raised play surface 70 disposed on first play surface 14. Raised play surface 70 may include a storage area configured to stow playset accessories. A playset accessory may include vehicle tow 22. Raised play surface 70 may include a tower 72 hingedly attached to raised play surface 70 such that tower 72 has an upright position and a lowered position. The playset 10 may further include a handle, for example base 12 may include a carrying handle 74. As shown in FIG. 1, toy vehicle 200 may be releasably attached to the playset 10 via socket 24 and transported via handle 74 without losing toy vehicle 200.

Playset 10 may include a set of interconnection arms (not shown) disposed within base 12 and/or slidably attached to first play surface 14, wherein one or more of the second, third and fourth play surfaces 16, 18, 20 may be hingedly attached to the set of interconnection arms. For example, a user may grasp and pull free end 64 of fourth play surface 20, thereby causing free end 56 of second play surface to move away from first play surface 14 and ends 60 of third play surface 18 to shift relative to first play surface 14.

Some embodiments of playset 10 may include a jet way 76, hingedly attached to raised play surface 70. Jet way 76 may be movable from a storage position (FIG. 1) to a passenger loading position (FIG. 2). In the passenger loading position, the distal end of jet way 76 may abut and/or be adjacent to an airplane mounted on socket 24. Jet way 76 may include a biasing member and may be biased to the passenger loading position. Jet way 76 may move from the storage position to the passenger loading position when one or more of the second, third and/or fourth play surfaces 16, 18, 20 are deployed into an expanded position.

In accordance with exemplary embodiments of the present disclosure, a playset may be described as follows. In one embodiment, toy playset includes a primary play surface, a pull-out platform and at least one swiveling platform that are interconnected so that pulling out the pull-out platform relative to the primary play surface causes the at least one swiveling platform to swivel relative to the primary play surface. Toy playset may further include sockets formed on a toy playset to clamp onto either (a) wheels of a toy vehicle where two wheels are relatively close to one another; or (b) an axle associated with two wheels of a toy vehicle that are relatively widely spaced apart.

In the disclosed embodiments, toy playset may be configured to look like an airport having a hanger, a helicopter pad, a communications tower, one or more runways and/or an airplane waiting area. A toy vehicle may include a toy aircraft, such as a jet plane, a fighter, a helicopter and/or other aircraft known to those skilled in the art. Other embodiments may have any other appearance known to those skilled in the art.

A particularly fun play pattern using toy playset includes moving toy playset from a storage position, in which a pull-out platform and at least one swiveling platform are disposed substantially on top of and/or underneath a primary play surface, to an expanded position, in which the majority of the pull-out platform and the majority of the at least one swiveling platform are at least partially disposed outside of the perimeter of the primary play surface. By expanding toy playset, more surface area for play and creativity is created. Toy playset may include a handle such that it is easily portable in the stowed position and/or sockets that clamp onto toy vehicles such that the toy vehicles do not fall off of the play set when in transport.

The various components of a playset may be fabricated from any suitable material, such as plastic, foamed plastic, flexible plastic, one or more layers of fabric, wood, cardboard, pressed paper, metal, or any combination of materials. A suitable material or combination of materials may be selected to provide a desirable synergy of weight, strength, durability, cost, and/or manufacturability.

While embodiments of a toy and methods of toy play have been particularly shown and described, many variations may be made therein. This disclosure may include one or more independent or interdependent embodiments directed to various combinations of features, functions, elements and/or properties. Other combinations and sub-combinations of features, functions, elements and/or properties may be claimed later in a related application. Such variations, whether they are directed to different combinations or directed to the same combinations, whether different, broader, narrower or equal in scope, are also regarded as included within the subject matter of the present disclosure. Accordingly, the foregoing embodiments are illustrative, and no single feature or element, or combination thereof, is essential to all possible combinations that may be claimed in this or a later application.

Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

What is claimed is:

1. A toy playset comprising:

a base having a first play surface; and a first socket rotatably attached to the first play surface by an attachment leg that is inserted in an attachment aperture formed in the first play surface, the first socket including a central detent configured to releasably retain a toy wheel with a portion of the toy wheel held inside the central detent, and a pair of lateral detents configured to releasably retain a toy axle, with the lateral detents extending across the first socket and intersecting the central detent, the lateral detents being narrower than the central detent.

2. The toy playset of claim 1, further comprising:

a second play surface attached to the base and moveable with respect to the first play surface thereby expanding the toy playset so that more surface area for play and creativity is created; and a second socket attached to the second play surface, the second socket including a central detent configured to releasably retain a toy wheel with a portion of the toy wheel held inside the central detent, and a pair of lateral detents configured to releasably retain a toy axle, with the lateral detents extending across the second socket and intersecting the central detent, the lateral detents being narrower than the central detent.

3. The toy playset of claim 2, further comprising:

a third play surface attached to the base and moveable with respect to the first play surface thereby expanding the toy playset so that more surface area for play and creativity is created; and a third socket attached to the third play surface, the third socket including a central detent configured to releasably retain a toy wheel with a portion of the toy wheel held inside the central detent, and a pair of lateral detents configured to releasably retain a toy axle, with the lateral detents extending across the third socket and intersecting the central detent, the lateral detents being narrower than the central detent.

4. The toy playset of claim 3, wherein the second socket is rotatably attached to the second play surface and the third socket is slidingly attached to the third play surface.

5. The toy playset of claim 2, wherein at least one of the second play surface and the third play surface is pivotally attached to the base and pivots with respect to the first play surface.

6. The toy playset of claim 1, wherein the base includes a carrying handle.

7. The toy playset of claim 1, further comprising a tow vehicle slidingly moveable on the first play surface, the tow vehicle including a tow socket;

the tow socket including a central detent configured to releasably retain a toy wheel with a portion of the toy wheel held inside the central detent, and a pair of lateral detents configured to releasably retain a toy axle, with the lateral detents extending across the first socket and intersecting the central detent, the lateral detents being narrower than the central detent.

8. A toy playset for use with toy vehicles, the vehicles including one or both of a single toy wheel and an axle supporting a pair of wheels, the playset comprising:

a base having a first play surface; and a first socket attached to the first play surface;

the first socket having a first retainer configured to releasably retain a single toy wheel within the first retainer in an exposed face of the first socket; and the first socket having a second retainer extending across the first socket, the second retainer configured to releasably retain an axle supporting a pair of wheels, with each of a pair of wheels held outside of the second retainer;

a tow vehicle slidingly moveable on the first play surface, the tow vehicle including a tow socket with a first retainer configured to releasably retain a single toy wheel within the first retainer in an exposed face of the tow socket, and with a second retainer configured to releasably retain a toy axle supporting a pair of wheels with each of a pair of wheels held outside of the tow socket.

9. The toy playset of claim 8, wherein the first retainer includes a central detent and the second retainer includes a pair of lateral detents;

the lateral detents extending across the first socket and intersecting the central detent, the lateral detents being narrower than the central detent.

10. The toy playset of claim 8, further comprising:

a second play surface attached to the base and moveable with respect to the first play surface; and a second socket attached to the second play surface;

the second socket having a first retainer configured to releasably retain a single toy wheel within the first retainer in an exposed face of the second socket; and the second socket having a second retainer extending across the second socket, the second retainer configured to releasably retain a toy axle supporting a pair of wheels, with each of a pair of wheels held outside of the second retainer.

11. The toy playset of claim 10, further comprising:

a third play surface attached to the base and moveable with respect to the first play surface; and a third socket attached to the third play surface;

the third socket having a first retainer configured to releasably retain a single toy wheel within the first retainer in an exposed face of the third socket; and the third socket having a second retainer extending across the third socket, the second retainer configured to releasably retain a toy axle supporting a pair of wheels, with each of a pair of wheels held outside of the second retainer.

12. The toy playset of claim 11, wherein third socket is slidingly attached to the third play surface.

13. A toy playset for use with toy vehicles, the vehicles including one or both of a single toy wheel and an axle supporting a pair of wheels, the playset comprising:

a base having a first play surface;

a second play surface attached to the base and moveable with respect to the first play surface, thereby expanding the toy playset so that more surface area for play and creativity is created; and a socket slidingly attached to a socket aperture in the second play surface;

the socket having a first retainer configured to releasably retain a single toy wheel within the first retainer in an exposed face of the socket; and the socket having a second retainer configured to releasably retain a toy axle supporting a pair of wheels, with each of a pair of wheels held outside of the socket.

14. The toy playset of claim 13, wherein the socket is rotatably attached to the second play surface.

15. The toy playset of claim 13, wherein the second play surface is pivotally attached to the base and pivots with respect to the first play surface.

16. The toy playset of claim 13, wherein the first retainer includes a central detent and the second retainer includes a pair of lateral detents;

the lateral detents extending across the socket and intersecting the central detent, the lateral detents being narrower than the central detent.

17. The toy playset of claim 13, wherein the base includes a carrying handle.

18. The toy playset of claim 13, further comprising a tow vehicle slidingly moveable on the first play surface and the second play surface, the tow vehicle including a tow socket;

the tow socket having a first retainer configured to releasably retain a single toy wheel within the first retainer in an exposed face of the tow socket; and the tow socket having a second retainer configured to releasably retain a toy axle supporting a pair of wheels, with each of a pair of wheels held outside of the tow socket.

19. The toy playset of claim 13, further comprising:

a third play surface attached to the base and moveable with respect to the first play surface.

20. A toy playset comprising:

a base having a first play surface; and a first socket attached to the first play surface, the first socket including a central detent configured to releasably retain a toy wheel with a portion of the toy wheel held inside the central detent, and a pair of lateral detents configured to releasably retain a toy axle, with the lateral detents extending across the first socket and intersecting the central detent, the lateral detents being narrower than the central detent;

a tow vehicle slidingly moveable on the first play surface, the tow vehicle including a tow socket with a central detent configured to releasably retain a toy wheel with a portion of the toy wheel held inside the central detent, and a pair of lateral detents configured to releasably retain a toy axle, with the lateral detents extending across the first socket and intersecting the central detent, the lateral detents being narrower than the central detent.

21. The toy playset of claim 20, further comprising:

a second play surface attached to the base and moveable with respect to the first play surface; and a second socket attached to the second play surface, the second socket including a central detent configured to releasably retain a toy wheel with a portion of the toy wheel held inside the central detent, and a pair of lateral detents configured to releasably retain a toy axle, with the lateral detents extending across the second socket and intersecting the central detent, the lateral detents being narrower than the central detent.

22. The toy playset of claim 21, further comprising:

a third play surface attached to the base and moveable with respect to the first play surface; and a third socket attached to the third play surface, the third socket including a central detent configured to releasably retain a toy wheel with a portion of the toy wheel held inside the central detent, and a pair of lateral detents configured to releasably retain a toy axle, with the lateral detents extending across the third socket and intersecting the central detent, the lateral detents being narrower than the central detent.

23. The toy playset of claim 22, wherein the second socket is rotatably attached to the second play surface and the third socket is slidingly attached to the third play surface.

24. The toy playset of claim 21, wherein at least one of the second play surface and the third play surface is pivotally attached to the base and pivots with respect to the first play surface.

* * * * *